United States Patent [19]

Eastman

[11] 4,333,272

[45] Jun. 8, 1982

[54] EXPANDABLE WINDOW DEVICE

[76] Inventor: Stephen B. Eastman, 5907 NE. 98th Ave., Vancouver, Wash. 98662

[21] Appl. No.: 155,576

[22] Filed: Jun. 2, 1980

[51] Int. Cl.[3] ..... E06B 1/04

[52] U.S. Cl. ..... 49/505; 49/63

[58] Field of Search ..... 49/505, 404, 63, 453, 49/468; 160/372, 374

[56] References Cited

U.S. PATENT DOCUMENTS

| | | | |
|---|---|---|---|
| 1,496,525 | 6/1924 | Coco | 49/505 X |
| 2,727,596 | 12/1955 | Smith | 49/505 X |
| 2,846,000 | 8/1958 | Kammerer | 49/63 X |
| 2,856,040 | 10/1958 | Dansereau | 49/505 X |
| 2,923,351 | 2/1960 | Zitomer | 49/505 X |
| 3,226,779 | 1/1966 | Rust | 49/63 X |
| 3,325,944 | 6/1967 | Crain | 49/453 X |
| 3,584,417 | 6/1971 | Gatton et al. | 49/404 |
| 3,967,412 | 7/1976 | Governale | 49/468 |

*Primary Examiner*—Philip C. Kannan
*Attorney, Agent, or Firm*—Klarquist, Sparkman, Campbell, Leigh, Whinston & Dellett

[57] ABSTRACT

An expandable window device usable as a storm window includes a track frame for supporting a pair of slidable window sashes. The edges of the track frame are received within U-shaped expander channels adjustable with respect to the track frame for engaging a window casing prior to installation of the window sashes in the track frame.

5 Claims, 4 Drawing Figures

EXPANDABLE WINDOW DEVICE

BACKGROUND OF THE INVENTION

The present invention relates to an expandable window device and particularly to such a device usable as an inside or outside storm window or as a principal window.

The installation of storm windows can be expensive, usually involving the custom manufacture of the storm window frames to fit the window casing of an individual building. Even when windows and window casings are nominally standard in size, it is rare that a correct fit of a matching storm window is achieved without exact measurement and fitting. Various types of expandable frames have been proposed heretofore, but none are really applicable to movable windows, i.e. windows that can be opened and closed in a conventional manner. Moreover, expandable frames heretofore suggested have been cumbersome in operation and unattractive in appearance rendering them mostly unacceptable in home and building construction as a substitute for custom-made windows. Furthermore, expandable frames of known types are not adaptable for use with main or principal windows in a building.

SUMMARY OF THE INVENTION

In accordance with the present invention, an expandable window device comprises a plurality of track members joined to form a track frame into which a window sash is slidably received. Plural, U-shaped expander channel members receive the frame members therewithin, and include at least one horizontal expander channel and at least one vertical expander channel. Adjustable expanding means extend from ones of the track members and engage ones of the expander channels for urging the expander channels toward the inside of the casing into which the window is to be located.

The adjustable expanding means preferably comprise threaded fasteners having a driving head within the track members and located along a central longitudinal partition which is broken, i.e. discontinuous, at the location of the fasteners. The threaded fasteners engage threads provided in upstanding ribs at the ends of the expander channels. The device including the expander channels is positioned in a casing structure and expanded prior to insertion of the slidable or movable sashes.

It is accordingly an object of the present invention to provide an improved expandable window device which is adapted for various size window casings.

It is another object of the present invention to provide an improved expandable window device which is attractive in appearance and usable in substantially every respect as an ordinary window.

It is another object of the present invention to provide an improved expandable window device which can be employed alternatively as an add-on storm window, or as a principal window in a building.

It is another object of the present invention to provide an expandable window device which is economical in construction and simple in operation.

It is another object of the present invention to provide an improved expandable window device which can be opened and which can be used in place of custom manufactured windows or storm windows.

The subject matter which I regard as my invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

DETAILED DESCRIPTION

Figure 1:
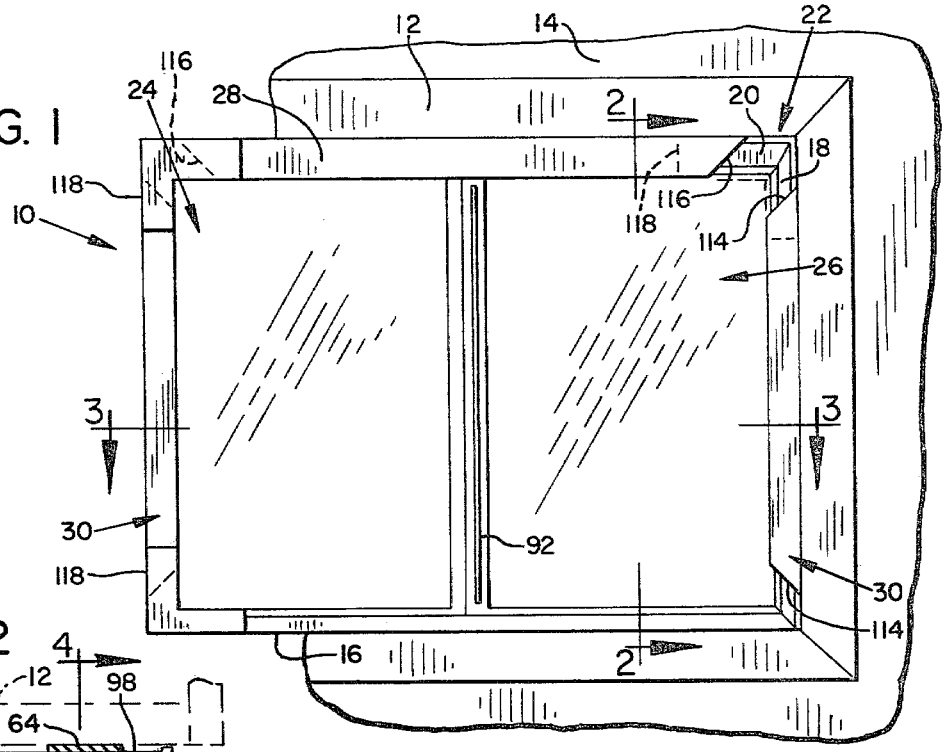
FIG. 1 is an elevational view, partially broken away, illustrating an expandable window device according to the present invention, as installed.

Referring to the drawings illustrating a particular embodiment of the present invention, a window device is adapted to be placed in an existing casing 12 located in wall 14, and which may or may not receive other windows. For example, the window device according to the present invention is adapted to function as a storm window either inside or outside a conventional or permanent window, or the window device according to the present invention may be employed as the primary or principal window. In the latter case, a pair of devices 10 may be employed, one forming the principal window and the other forming a storm window for additional heat insulation. The drawings illustrate inside storm window usage.

The window device 10 comprises a plurality of track members and in particular a sill track member 16, jamb track members 18, and a header track member 20 which are joined in rectangular fashion by miter joints to form a track frame 22 into which a window sash or a pair of window sashes 24 and 26 are slidably received, with the combination forming a slider or casement type window. The header track member and the jamb track members are respectively received within U-shaped expander channel members 28 and 30 which, as hereinafter more fully described, are urged outwardly to match the window casing. Sill track member 16 is suitably disposed on the casing sill without employing an expander channel even though an expander channel can also be located along the sill if so desired. The sill track member 16 is U-shaped in overall cross section having a central upstanding partition 32 for dividing the sill track member into a pair of parallel tracks along which sashes 24 and 26 may slide. In the middle of each of the parallel tracks a rail 34 is located upon which plastic insert runner 36 bears. This plastic insert runner extends along the bottom frame member of the sash, being secured in groove 38. Header track member 20 is substantially H-shaped having side flanges 40 and 42 for sliding within expander channel 28, and a central web 44 completing a track configuration with the flanges. A central partition 46 is upstanding from the web 44 and is disposed in substantially parallel relation to flanges 40 and 42 to complete a double track configuration receiving upwardly extending sashes 24 and 26.

At suitable locations along header track 20, e.g. at a pair of spaced locations, the same is provided with adjustable expanding means desirably in the form of threaded screws or screw fasteners 48. Each screw fastener 48 comprises a flathead screw received in a countersunk hole 50 located at approximately the vertical center line of the header track member 20. The screw fastener 48 matingly engages a female thread on rib 52 which extends centrally of expander channel member 28, and screw fastener 48 is also provided with a keeper or washer 54 secured to the shank thereof just under web 44. Consequently, turning of screw fastener 48 from its driving head within the track member moves expander channel member 28, and specifically end wall 98 thereof, outwardly, i.e. upwardly, with respect to the track member, so as to bear against the casing 12 and secure the window device in place. It is noted the partition 46 is broken proximate screw fastener 48, e.g. by drilling, to provide access aperture 56. The head of the screw fastener extends laterally into the parallel tracks provided for the sliding sashes, but since the screw head is countersunk, interference with the sashes after installation is avoided.

The expander channel member 28 includes sides 94 and 96 adapted to receive the track member 20 therewithin over the range of relative positions of members 20 and 28. Therefore, the window construction retains the appearance of a conventional window frame. The sides 94 and 96 may also include inner in-turned flanges 110 which limit the travel of the track member 20.

It will also be noted the upper part of flange 42 of header track member 20 is widened and provided with a slot 105 carrying a strip 106 of mohair sealing material which bears on the inside of expander channel member 28. Thus, a weather sealing relation is maintained despite the adjustability between the parts.

Figure 2:
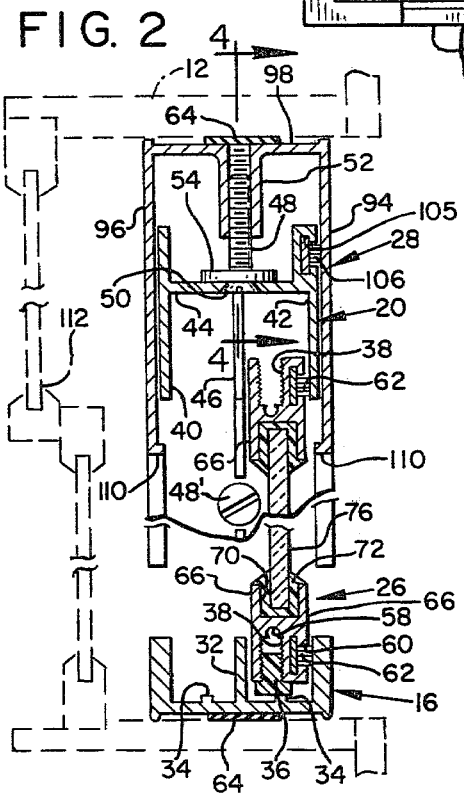
FIG. 2 is a vertical cross-sectional view of the FIG. 1 window device as taken at 2—2 in FIG. 1.
Figure 3:
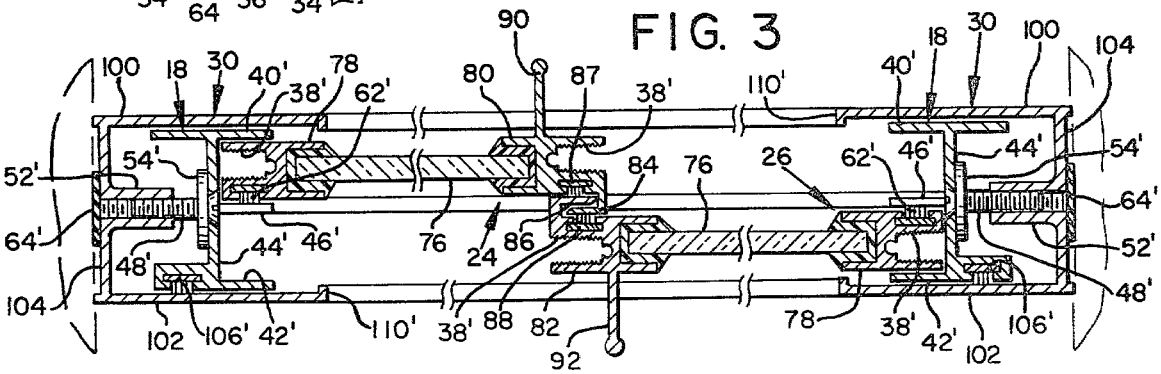
FIG. 3 is a transverse cross section of the FIG. 1 window device as taken at 3—3 in FIG. 1.

As will be observed in FIG. 3, the construction of the jamb track members 18 is substantially similar to that of header track member 20 with the exception that in the particular embodiment the track member 20 flanges were somewhat longer toward the sash frames. This provides a somewhat deeper double track on the header track member allowing the sashes 24 and 26 to be upraised into the header track member for installing and removing the sashes in the usual manner for slide windows. Thus, there is extra space between flanges 40 and 42 and sash frame member 66 in FIG. 2 so that a sash frame can be slid upwardly into the track cavity of header track member 20 while the lower part of the sash frame clears sill track member 16 and can simply be rotated out of or into the track frame. Care must be taken when installing the window device that sufficient space is left above the position of the window sash to accommodate reception and removal of the sash. In other respects, the component elements of the jamb track members 18 as shown in FIG. 3 are substantially the same as those of track member 20 and are referred to with primed reference numerals. Operation is also the same. Thus, by use of adjusting screws 48', the jamb expander channel members are urged outwardly against the casing jambs to secure the track frame in place. The expander channel members 30, including sides 100, 102 and end 104, are substantially the same in construction as similar elements 94, 96 and 98 of expander channel member 28 except that sides 100 and 102 are not as long as sides 94 and 96 inasmuch as the latter must accommodate positioning of the longer flanges 40 and 42. Moreover, the total adjustability with this embodiment in the vertical direction is provided by the top expander channel member 28, while horizontal adjustment can be divided between side expander channel members 30. A cushioning and sealing pad 64 is provided between sill track member 16 and the casing as well as between header expander channel 28 and the casing. Similarly, pads 64' are disposed between jamb expander channel members 18 and the casing.

The sash 26 includes upper and lower sash frame members 66, a side edge sash frame member 78 and a center side sash frame member 82. As hereinbefore indicated, the lower sash frame member 66 is provided with a runner 36 adapted to ride on track rail 34. The upper sash frame member 66 is also provided with a slot 38 which may accommodate a strip of insulating material, and which is also employed for joinder of the sash frame as hereinafter mentioned. Sash frame side members 78 and 82 include similar slots 38'. All of the frame parts for both the sash frame and track frame and the expander channel members suitably comprise sturdy extruded metal sections, e.g. aluminum.

The sash frame members 66 are grooved at 70, inwardly of the sash frame, and are provided with a liner 72 receiving glass pane 76. The sash frame members 78 and 82 are similarly constructed and, with frame members 66, form a rectangular frame joined at its mitered corners in a conventional manner through apertures 58 at the ends of slots 38, 38'. Each of the sash frame members 66 has a side groove 60 receiving a strip 62 of mohair or the like for sealing against the inside of the respective track frame members. A similar strip 62' is located along the edge of sash frame member 78 for sealing against track frame member 18 when the window is closed. The construction as described for sash 26 is also applicable to sash 24, wherein like elements are designated by primed reference numerals, it being understood a vertical cross section through sash 24 would comprise a mirror image of a vertical cross section (FIG. 2) through sash 26.

Where the sash frames overlap in the middle of the window device, sash frame 26 is provided with a side frame member 82 having an outwardly extending bar handle 92 and a reversely turned forward lip 86 located on the opposite side of the frame member 82 from handle 92, i.e. on the side adjacent sash 24. Similarly, side frame member 80 of sash 24 includes a bar handle 90 protruding laterally outwardly on the opposite side of the window construction, the frame member 80 being further provided with a reversely turned forward lip 84 on the side disposed toward frame member 82 and dimensioned for hooking engagement with lip 86 of member 82. As can be seen in FIG. 3, the lips 84 and 86 are arranged for hooking engagement when the sashes are located in positions for closing the window. Moreover, sash frame members 80 and 82 respectively include sealing strips 87 and 88 for bearing against lips 86 and 84 respectively when the sashes are closed.

Figure 4:
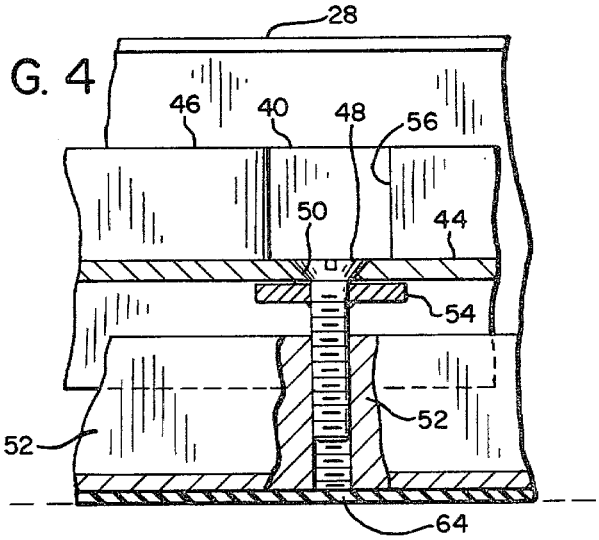
FIG. 4 is a cross-sectional magnified view of adjustable expanding means according to the present invention, said view being taken at 4—4 in FIG. 2 and rotated 180°.

The window device according to the present invention is adapted to fit a range of window casing sizes and constructions, with at least a pair of adjustable expanding means such as depicted in FIG. 4 being located along each side and the top of the track frame. That is, at least two such expanding means are spaced along track frame member 20, and at least two such expanding means are spaced along each of the jamb track members 18. Although no expanding means have been illustrated with respect to sill track 16, it is understood they could be so employed. For allowing for expansion, each of the expander channel members are foreshortened in length. For example as illustrated in FIG. 1, jamb expander channel member 30 is chamfered at a 45 degree angle at locations 114, short of the corners of the window construction, and head expander channel member 28 is similarly chamfered at 116. Each of the corners is then covered by an L-shaped or 90 degree plastic corner channel 118 which is positioned in place on the corners before the window device is secured in the casing. These corner channels merely fit over the corners and comprise a slightly large size extension of the respective expander channel members.

In the drawings, the window device according to the present invention has been primarily illustrated as an inside storm window which is expanded in place against a casing having an opening wider than it is high, e.g. the window device according to the present invention is suitable for use in association with an already installed principal casement or slider window. However, the construction can be employed in conjunction with a double-hung window 112 as illustrated in FIG. 2, or the window device according to the present invention may comprise the principal or only window located in a given casing. Of course pairs of window devices can be utilized in parallel spaced relation to one another wherein one or the other may be viewed as the storm window. Also, the window device according to the present invention can be employed as an outside storm window rather than an inside storm window.

In installing the window device according to the embodiment shown, the adjustable expanding means are adjusted to slightly less than the inside dimensions of the casing, after which the corner channels are installed over the expander channel frame. The device is then positioned where desired and the expander channels are urged outwardly employing the adjustable expanding means which are turned by engaging the screw driving heads with a screwdriver inside the track frame before the sashes are installed. Lastly, the sashes are installed by slipping the same upwardly into track member 20 and then downwardly into track member 16.

While I have shown and described a preferred embodiment of my invention, it will be apparent to those skilled in the art that many changes and modifications may be made without departing from my invention in its broader aspects, I therefore intend the appended claims to cover all such changes and modifications as fall within the true spirit and scope of my invention.

I claim:

1. An expandable window device adaptable for various size casings, said window device comprising:

plurality of track members including a sill track member, a header track member and jamb track members joined to form a track frame into which a window sash is slidably received, at least one U-shaped horizontal expander channel receiving therewithin a horizontally disposed track member, and at least one U-shaped vertical expander channel receiving therewithin a vertically disposed jamb track member, and expanding means extending from ones of said track members and engaging ones of said expander channels for urging said expander channels toward the inside of the casing into which the window is to be located, wherein said expanding means comprise plural threaded fasteners rotatable from within said track frame and threadably engaging said ones of said expander channels for adjustably urging the same toward the inside of the casing, ones of said track members being substantially H-shaped in cross section having side flanges over which said expander channels are slidable and a web between said side flanges for receiving a said threaded fastener, a said threaded fastener extending for making a threaded connection with a rib at the end of a said expander channel, wherein a said H-shaped track member is provided with a central longitudinal track partition toward said window sash for forming a double track adaptable for receiving either one of a pair of window sashes, said central longitudinal partition having breaks at locations of said threaded fasteners, each of said fasteners comprising a flathead screw having a driving head received in a countersunk hole in the web of a said track member and accessible from within the said track member.

2. The device according to claim 1 wherein said track members and said expander channels comprise extruded metal frame sections.

3. The device according to claim 1 wherein a threaded fastener is provided with a keeper secured thereto on the opposite side of said web from said driving head.

4. An expandable window device adaptable for various size casings, said window device comprising:

a plurality of track members including a sill track member, a header track member and jamb track members joined to form a track frame for receiving a window, at least one horizontal expander channel member cooperating with a horizontally disposed track member, and at least one vertical expander channel member cooperating with a vertically disposed jamb track member, and plural adjustable expanding means extending from ones of said track members and engaging ones of said expander channel members for urging said expander channel members toward the inside of the casing into which the window is to be located, said expanding means each having a driving head accessible from within the said track member, wherein a said track member receiving the driving head of a said adjustable expanding means has a track which is discontinuous at locations to receive said adjustable expanding means.

5. The device according to claim 4 wherein said driving head is normally flush with the inner surface of said track member.

* * * * *